US012264858B2

(12) United States Patent
Zha

(10) Patent No.: US 12,264,858 B2
(45) **Date of Patent: *Apr. 1, 2025**

(54) COOLING SYSTEM WITH OIL RETURN TO ACCUMULATOR

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/440,567

(22) Filed: Feb. 13, 2024

(65) Prior Publication Data

US 2024/0183595 A1 Jun. 6, 2024

Related U.S. Application Data

(63) Continuation of application No. 16/803,306, filed on Feb. 27, 2020, now Pat. No. 11,933,527.

(51) Int. Cl.

| | |
|---|---|
| ***F25B 43/02*** | (2006.01) |
| ***F25B 41/20*** | (2021.01) |
| ***F25B 43/00*** | (2006.01) |

(52) U.S. Cl.

CPC ..... *F25B 43/02* (2013.01); *F25B 41/20* (2021.01); *F25B 43/006* (2013.01); *F25B 2500/04* (2013.01); *F25B 2600/2519* (2013.01); *F25B 2700/03* (2013.01); *F25B 2700/2103* (2013.01)

(58) Field of Classification Search

CPC ..... F25B 43/02; F25B 41/20; F25B 43/006; F25B 2500/04; F25B 2600/2519; F25B 2700/03; F25B 2700/2103

See application file for complete search history.

(56) References Cited

U.S. PATENT DOCUMENTS 11,933,527 B2 * 3/2024 Zha ..... F25B 49/02

FOREIGN PATENT DOCUMENTS

| | | |
|---|---|---|
| EP | 3550222 A1 | 10/2019 |
| EP | 3575712 A1 | 12/2019 |
| EP | 3591313 A2 | 1/2020 |
| EP | 3591313 A3 | 3/2020 |

OTHER PUBLICATIONS

European Patent Office, Extended European Search Report, Application No. 21158829.8, dated Jul. 9, 2021, 9 pages.

* cited by examiner

*Primary Examiner* — Nael N Babaa

(57) ABSTRACT

A cooling system drains oil from low side heat exchangers to vessels and then uses compressed refrigerant to push the oil in the vessels back towards a compressor. Generally, the cooling system operates in three different modes of operation: a normal mode, an oil drain mode, and an oil return mode. During the normal mode, a primary refrigerant is cycled to cool one or more secondary refrigerants. As the primary refrigerant is cycled, oil from a compressor may mix with the primary refrigerant and become stuck in a low side heat exchanger. During the oil drain mode, the oil in the low side heat exchanger is allowed to drain into a vessel. During the oil return mode, compressed refrigerant is directed to the vessel to push the oil in the vessel back towards a compressor.

20 Claims, 5 Drawing Sheets

COOLING SYSTEM WITH OIL RETURN TO ACCUMULATOR

CROSS-REFERENCE TO RELATED APPLICATION

The application is a continuation of U.S. patent application Ser. No. 16/803,306, filed Feb. 27, 2020, entitled "COOLING SYSTEM WITH OIL RETURN TO ACCUMULATOR," now U.S. Pat. No. 11,933,527 issued Mar. 19, 2024, which is incorporated herein by reference.

TECHNICAL FIELD

This disclosure relates generally to a cooling system.

BACKGROUND

Cooling systems cycle refrigerant to cool various spaces.

SUMMARY

Cooling systems cycle refrigerant to cool various spaces. For example, in some industrial facilities, cooling systems cycle a primary refrigerant that cools secondary refrigerants. The secondary refrigerants are then cycled to cool different parts of the industrial facility (e.g., different industrial and/or manufacturing processes). These systems typically include a compressor to compress the primary refrigerant and a high side heat exchanger that removes heat from the compressed primary refrigerant. When the compressor compresses the primary refrigerant, oil that coats certain components of the compressor may mix with and be discharged with the primary refrigerant.

Depending on the nature of the primary refrigerant, the cooling system may be able to move the oil along with the primary refrigerant through the cooling system such that the oil is eventually cycled back to the compressor. However, when certain primary refrigerants (e.g., carbon dioxide) are used, the oil may get stuck in a portion of the cooling system (e.g., at a low side heat exchanger). As a result, the compressor(s) in the system begin losing oil, which eventually leads to breakdown or failure. Additionally, the components in which the oil gets stuck may also become less efficient as the oil builds in these components.

This disclosure contemplates an unconventional cooling system that drains oil from low side heat exchangers to vessels and then uses compressed refrigerant to push the oil in the vessels back towards a compressor. Generally, the cooling system operates in three different modes of operation: a normal mode, an oil drain mode, and an oil return mode. During the normal mode, a primary refrigerant is cycled to cool one or more secondary refrigerants. As the primary refrigerant is cycled, oil from a compressor may mix with the primary refrigerant and become stuck in a low side heat exchanger. During the oil drain mode, the oil in the low side heat exchanger is allowed to drain into a vessel. During the oil return mode, compressed refrigerant is directed to the vessel to push the oil in the vessel back towards a compressor. In this manner, oil in a low side heat exchanger is returned to a compressor. Certain embodiments of the cooling system are described below.

According to an embodiment, a system includes a flash tank, a first low side heat exchanger, an accumulator, a first compressor, a second compressor, a first valve, and a second valve. The flash tank stores a primary refrigerant. During a first mode of operation, the first and second valves are closed, the first low side heat exchanger uses primary refrigerant from the flash tank to cool a secondary refrigerant, the accumulator receives primary refrigerant from the first low side heat exchanger, the first compressor compresses primary refrigerant from the accumulator, and the second compressor compresses primary refrigerant from the first compressor. During a second mode of operation, the first valve is open and directs primary refrigerant from the first low side heat exchanger and an oil from the first low side heat exchanger to a vessel and the second valve is closed. During a third mode of operation, the first valve is closed and the second valve is open and directs primary refrigerant from the first compressor to the vessel. The primary refrigerant from the first compressor pushes the oil in the vessel to the accumulator.

According to another embodiment, a method includes storing, by a flash tank, a primary refrigerant. During a first mode of operation, the method includes closing a first valve and a second valve, using, by a first low side heat exchanger, primary refrigerant from the flash tank to cool a secondary refrigerant, receiving, by an accumulator, primary refrigerant from the first low side heat exchanger, compressing, by a first compressor, primary refrigerant from the accumulator, and compressing, by a second compressor, primary refrigerant from the first compressor. During a second mode of operation, the method includes opening the first valve, closing the second valve, and directing, by the first valve, primary refrigerant from the first low side heat exchanger and an oil from the first low side heat exchanger to a vessel. During a third mode of operation, the method includes closing the first valve, opening the second valve, directing, by the second valve, primary refrigerant from the first compressor to the vessel, and pushing, by the primary refrigerant from the first compressor, the oil in the vessel to the accumulator.

According to yet another embodiment, a system includes a high side heat exchanger, a flash tank, a first low side heat exchanger, an accumulator, a first compressor, a second compressor, a first valve, and a second valve. The high side heat exchanger removes heat from a primary refrigerant. The flash tank stores the primary refrigerant. During a first mode of operation, the first and second valves are closed, the first low side heat exchanger uses primary refrigerant from the flash tank to cool a secondary refrigerant, the accumulator receives primary refrigerant from the first low side heat exchanger, the first compressor compresses primary refrigerant from the accumulator, and the second compressor compresses primary refrigerant from the first compressor. During a second mode of operation, the first valve is open and directs primary refrigerant from the first low side heat exchanger and an oil from the first low side heat exchanger to a vessel and the second valve is closed. During a third mode of operation, the first valve is closed and the second valve is open and directs primary refrigerant from the first compressor to the vessel. The primary refrigerant from the first compressor pushes the oil in the vessel to the accumulator.

Certain embodiments provide one or more technical advantages. For example, an embodiment allows oil to be drained from a low side heat exchanger and returned to a compressor, which may improve the efficiency of the low side heat exchanger and the lifespan of the compressor. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
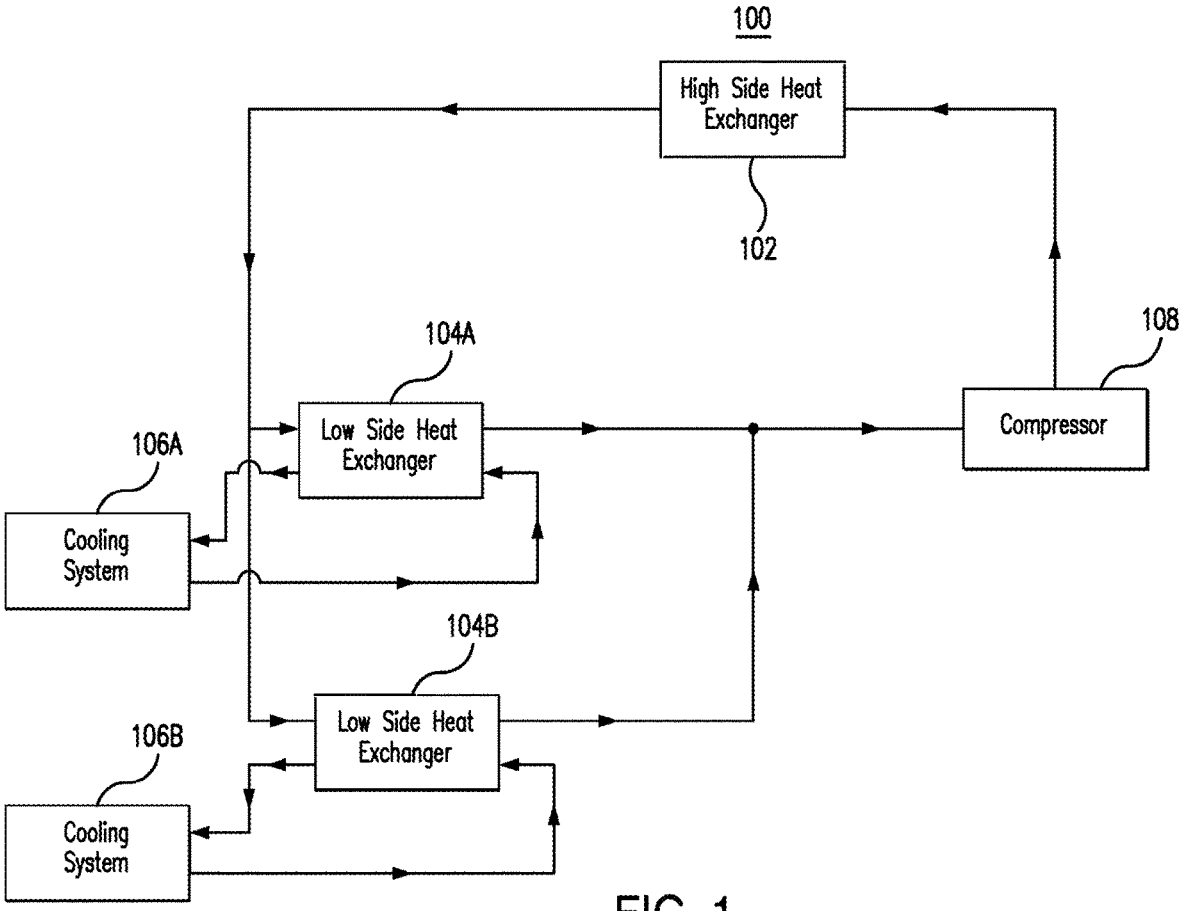
FIG. 1 illustrates an example cooling system.
Figure 2A:
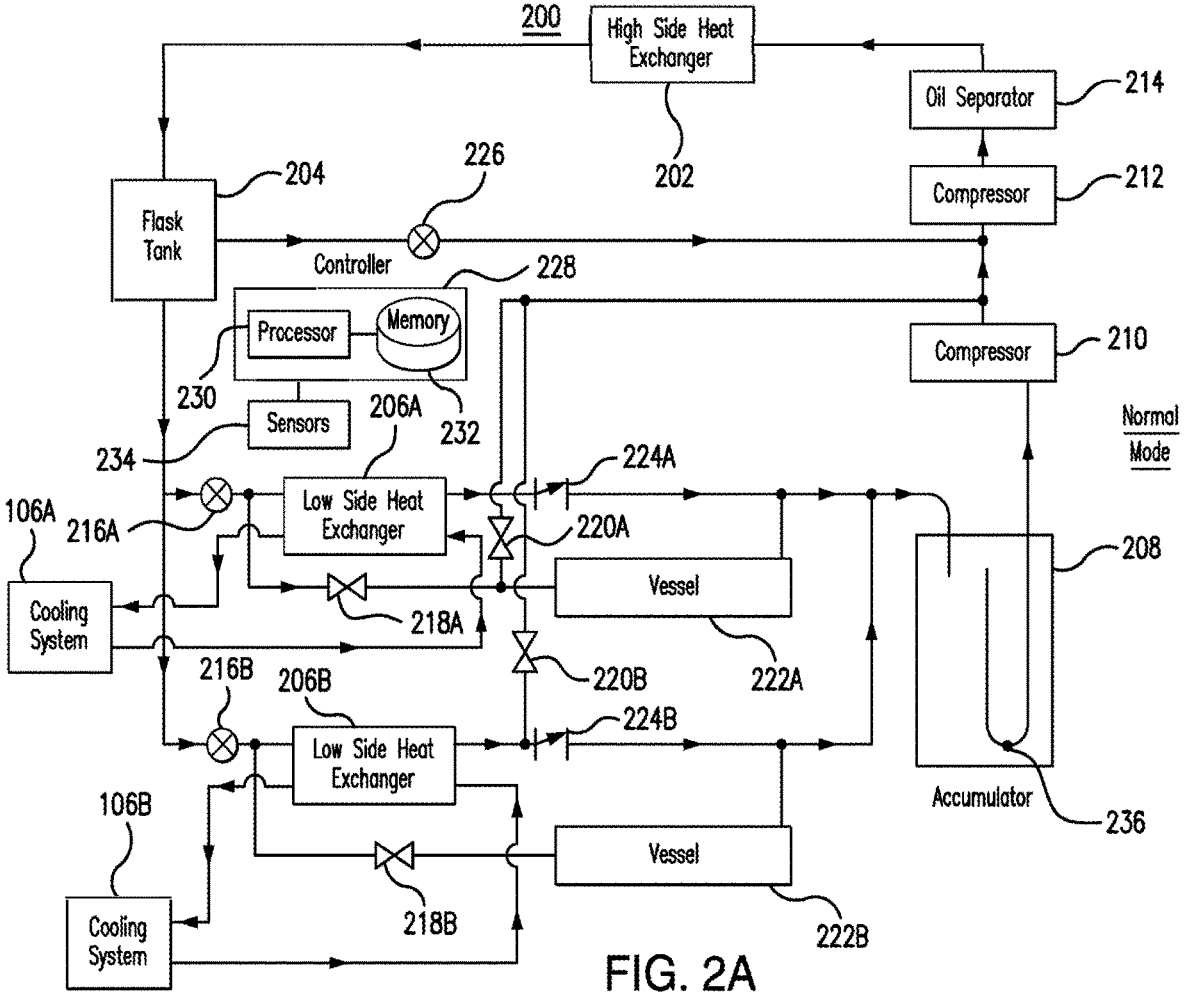
FIGS. 2A-2C illustrate an example cooling system.
Figure 2B:
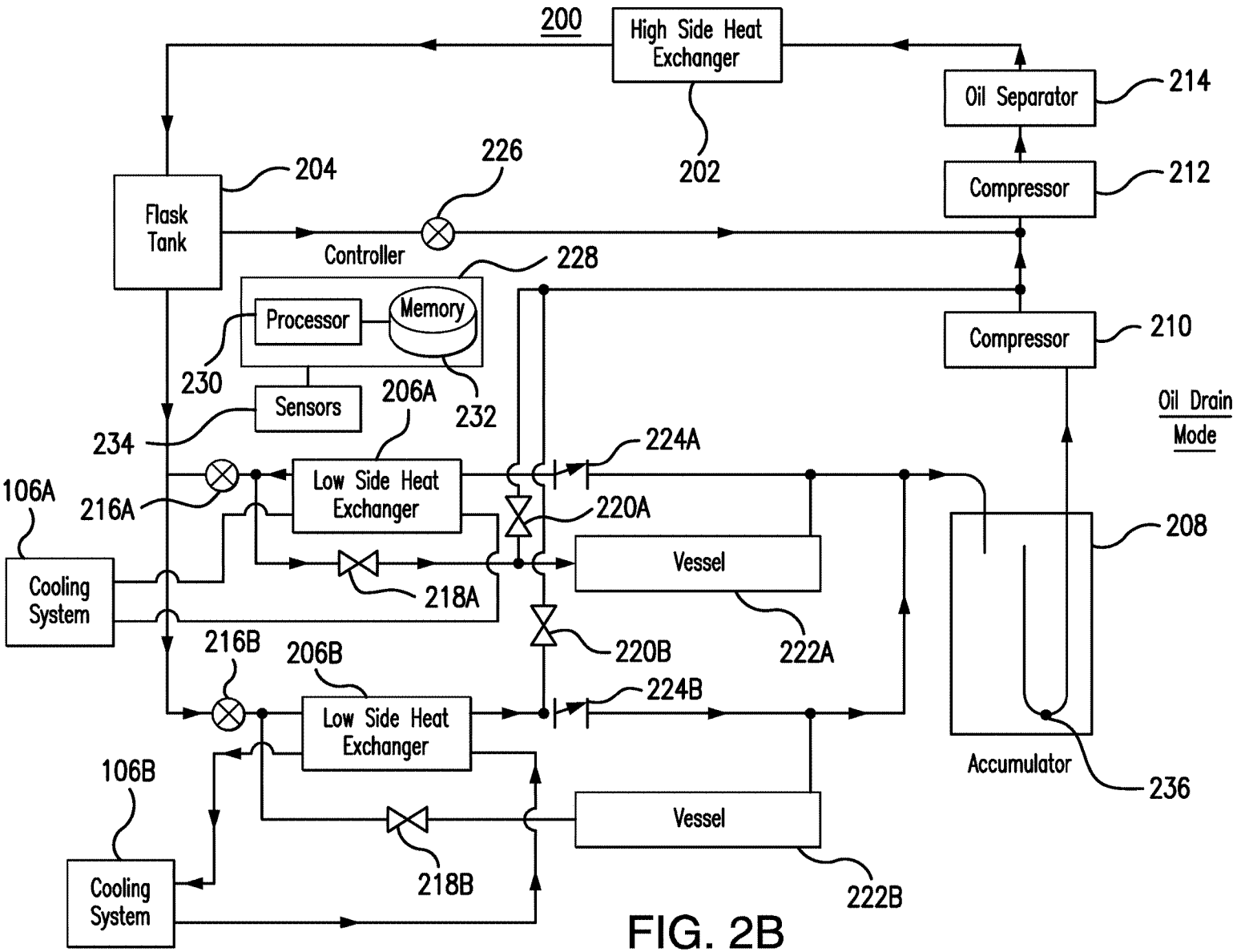
Figure 2C:
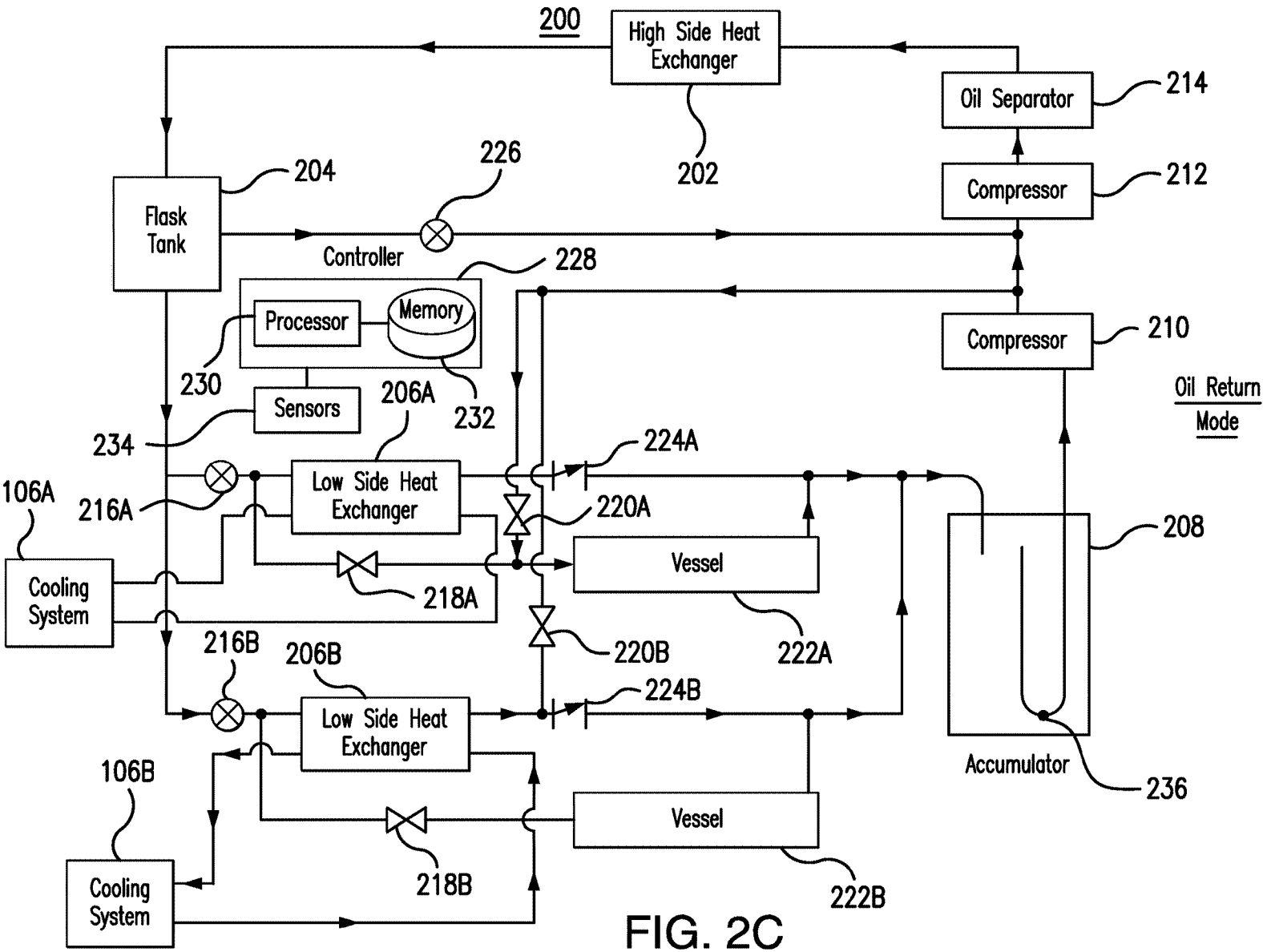
Figure 3:
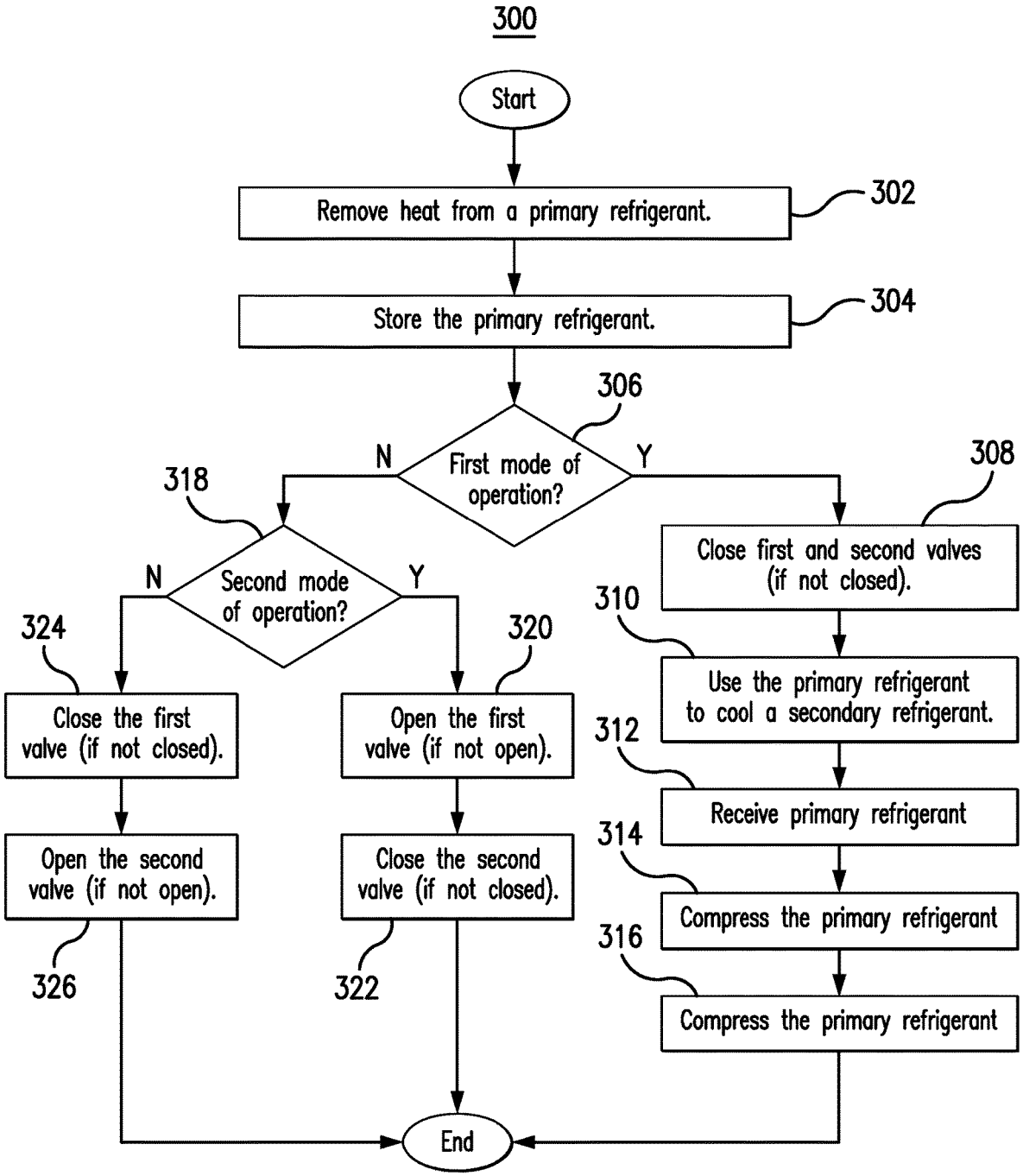
FIG. 3 is a flowchart illustrating a method of operating an example cooling system.

Embodiments of the present disclosure and its advantages are best understood by referring to FIGS. 1 through 3 of the drawings, like numerals being used for like and corresponding parts of the various drawings.

Cooling systems cycle refrigerant to cool various spaces. For example, in some industrial facilities, cooling systems cycle a primary refrigerant that cools secondary refrigerants. The secondary refrigerants are then cycled to cool different parts of the industrial facility (e.g., different industrial and/or manufacturing processes). These systems typically include a compressor to compress the primary refrigerant and a high side heat exchanger that removes heat from the compressed primary refrigerant. When the compressor compresses the primary refrigerant, oil that coats certain components of the compressor may mix with and be discharged with the primary refrigerant.

Depending on the nature of the primary refrigerant, the cooling system may be able to move the oil along with the primary refrigerant through the cooling system such that the oil is eventually cycled back to the compressor. However, when certain primary refrigerants (e.g., carbon dioxide) are used, the oil may get stuck in a portion of the cooling system (e.g., at a low side heat exchanger). As a result, the compressor(s) in the system begin losing oil, which eventually leads to breakdown or failure. Additionally, the components in which the oil gets stuck may also become less efficient as the oil builds in these components.

This disclosure contemplates an unconventional cooling system that drains oil from low side heat exchangers to vessels and then uses compressed refrigerant to push the oil in the vessels back towards a compressor. Generally, the cooling system operates in three different modes of operation: a normal mode, an oil drain mode, and an oil return mode. During the normal mode, a primary refrigerant is cycled to cool one or more secondary refrigerants. As the primary refrigerant is cycled, oil from a compressor may mix with the primary refrigerant and become stuck in a low side heat exchanger. During the oil drain mode, the oil in the low side heat exchanger is allowed to drain into a vessel. During the oil return mode, compressed refrigerant is directed to the vessel to push the oil in the vessel back towards a compressor. In this manner, oil in a low side heat exchanger is returned to a compressor. The cooling system will be described using FIGS. 1 through 3. FIG. 1 will describe an existing cooling system. FIGS. 2A-2C and 3 describe the cooling system that drains oil from a low side heat exchanger.

FIG. 1 illustrates an example cooling system 100. As shown in FIG. 1, system 100 includes a high side heat exchanger 102, low side heat exchangers 104A and 104B, cooling systems 106A and 106B, and compressor 108. Generally, system 100 cycles a primary refrigerant to cool secondary refrigerants used by cooling systems 106A and 106B. Cooling system 100 or any cooling system described herein may include any number of low side heat exchangers.

High side heat exchanger 102 removes heat from a primary refrigerant. When heat is removed from the refrigerant, the refrigerant is cooled. High side heat exchanger 102 may be operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. This disclosure contemplates any suitable refrigerant being used in any of the disclosed cooling systems.

Low side heat exchangers 104A and 104B transfer heat from secondary refrigerants from cooling systems 106A and 106B to the primary refrigerant from high side heat exchanger 102. As a result, the primary refrigerant heats up and the secondary refrigerants are cooled. The cooled secondary refrigerants are then directed back to cooling systems 106A and 106B to cool components in cooling systems 106A and 106B. In the example of FIG. 1, low side heat exchanger 104A transfers heat from a secondary refrigerant from cooling system 106A to the primary refrigerant from high side heat exchanger 102 and low side heat exchanger 104B transfers heat from a second refrigerant from cooling system 106B to the primary refrigerant from high side heat exchanger 102. Cooling systems 106A and 106B may use the same or different secondary refrigerants.

Cooling systems 106A and 106B may use the secondary refrigerants to cool different things. For example, cooling systems 106A and 106B may be installed in an industrial facility and cool different portions of the industrial facility, such as different industrial and/or manufacturing processes. When these processes are cooled, the secondary refrigerants are heated and cycled back to low side heat exchangers 104A and 104B, where the secondary refrigerants are cooled again.

Primary refrigerant flows from low side heat exchangers 104A and 104B to compressor 108. The disclosed cooling systems may include any number of compressors 108. Compressor 108 compresses primary refrigerant to increase the pressure of the refrigerant. As a result, the heat in the refrigerant may become concentrated. When the compressor 108 compresses the refrigerant, oil that coats certain components of compressor 108 may mix with and be discharged with the refrigerant. Depending on the nature of the primary refrigerant, cooling system 100 may be able to move the oil along with the primary refrigerant through cooling system 100 such that the oil is eventually cycled back to compressor 108. However, when certain primary refrigerants (e.g., carbon dioxide) are used, the oil may get stuck in a portion of the cooling system (e.g., at low side heat exchangers 104A and 104B). As a result, compressor 108 loses oil, which eventually leads to breakdown or failure. Additionally, the components in which the oil gets stuck may also become less efficient as the oil builds in these components.

This disclosure contemplates an unconventional cooling system that drains oil from low side heat exchangers to vessels and then uses compressed refrigerant to push the oil in the vessels back towards a compressor. Generally, the cooling system operates in three different modes of operation: a normal mode, an oil drain mode, and an oil return mode. During the normal mode, a primary refrigerant is cycled to cool one or more secondary refrigerants. As the primary refrigerant is cycled, oil from a compressor may mix with the primary refrigerant and become stuck in a low side heat exchanger. During the oil drain mode, the oil in the low side heat exchanger is allowed to drain into a vessel. During the oil return mode, compressed refrigerant is directed to the vessel to push the oil in the vessel back towards a compressor. In this manner, oil in a low side heat exchanger is returned to a compressor. The unconventional system will be described in more detail using FIGS. 2A-2C and 3.

FIGS. 2A-2C illustrate an example cooling system 200. As seen in FIGS. 2A-2C, cooling system 200 includes a high side heat exchanger 202, a flash tank 204, low side heat exchangers 206A and 206B, an accumulator 208, a compressor 210, a compressor 212, an oil separator 214, valves 216A and 216B, valves 218A and 218B, valves 220A and 220B, vessels 222A and 222B, valves 224A and 224B, valve 226, controller 228, and one or more sensors 234. Generally, cooling system 200 operates in three modes of operation: a normal mode of operation, an oil drain mode of operation, and an oil return mode of operation. FIG. 2A illustrates cooling system 200 operating in the normal mode of operation. FIG. 2B illustrates cooling system 200 operating in the oil drain mode of operation. FIG. 2C illustrates cooling system 200 operating in the oil return mode of operation. By cycling through these modes of operation, cooling system 200 can direct oil in low side heat exchangers 206A and 206B towards compressors 210 and 212.

High side heat exchanger 202 operates similarly as high side heat exchanger 102 in cooling system 100. Generally, high side heat exchanger 202 removes heat from a primary refrigerant (e.g., carbon dioxide) cycling through cooling system 200. When heat is removed from the refrigerant, the refrigerant is cooled. High side heat exchanger 202 may be operated as a condenser and/or a gas cooler. When operating as a condenser, high side heat exchanger 202 cools the refrigerant such that the state of the refrigerant changes from a gas to a liquid. When operating as a gas cooler, high side heat exchanger 202 cools gaseous refrigerant and the refrigerant remains a gas. In certain configurations, high side heat exchanger 202 is positioned such that heat removed from the refrigerant may be discharged into the air. For example, high side heat exchanger 202 may be positioned on a rooftop so that heat removed from the refrigerant may be discharged into the air. This disclosure contemplates any suitable refrigerant being used in any of the disclosed cooling systems.

Flash tank 204 stores primary refrigerant received from high side heat exchanger 202. This disclosure contemplates flash tank 204 storing refrigerant in any state such as, for example, a liquid state and/or a gaseous state. Refrigerant leaving flash tank 204 is fed to low side heat exchanger(s) 206A and/or 206B. In some embodiments, a flash gas and/or a gaseous refrigerant is released from flash tank 204. By releasing flash gas, the pressure within flash tank 204 may be reduced.

Low side heat exchangers 206A and 206B may operate similarly as low side heat exchangers 104A and 104B in cooling system 100. System 200 may include any suitable number of low side heat exchangers 206. Generally low side heat exchangers 206A and 206B transfer heat from secondary refrigerants (e.g., water, glycol, etc.) to the primary refrigerant (e.g., carbon dioxide) in cooling system 200. As a result, the primary refrigerant is heated while the secondary refrigerant is cooled. Low side heat exchangers 206A and 206B may include any suitable structure (e.g., plates, tubes, fins, etc.) for transferring heat between refrigerants. For example, low side heat exchangers 206A and 206B may be shell tube or shell plate type evaporators commonly found in industrial facilities.

Low side heat exchangers 206A and 206B then direct cooled secondary refrigerant to cooling systems 106A and 106B. In the example of FIGS. 2A-2C, low side heat exchanger 206A directs cooled secondary refrigerant to cooling system 106A and low side heat exchanger 206B directs cooled secondary refrigerant to cooling system 106B. Low side heat exchangers 206A and 206B may cool different secondary refrigerants. Cooling systems 106A and 106B may use different secondary refrigerants. In other words, low side heat exchanger 206A may cool and cooling system 106A may use a secondary refrigerant while low side heat exchanger 206B may cool and cooling system 106B may use a tertiary refrigerant.

Cooling systems 106A and 106B may use the cooled secondary refrigerants from low side heat exchangers 206A and 206B to cool different things, such as for example, different industrial processes and/or methods. The secondary refrigerants may then be heated and directed back to low side heat exchangers 206A and 206B for cooling. System 200 may include any suitable number of cooling systems 106.

Accumulator 208 receives primary refrigerant from one or more of low side heat exchangers 206A and 206B. Accumulator 208 may separate a liquid portion from a gaseous portion of the refrigerant. For example, refrigerant may enter through a top surface of accumulator 208. A liquid portion of the refrigerant may drop to the bottom of accumulator 208 while a gaseous portion of the refrigerant may float towards the top of accumulator 208. Accumulator 208 includes a U-shaped pipe that sucks refrigerant out of accumulator 208. Because the end of the U-shaped pipe is located near the top of accumulator 208, the gaseous refrigerant is sucked into the end of the U-shaped pipe while the liquid refrigerant collects at the bottom of accumulator 208.

Compressor 210 compresses primary refrigerant discharged by accumulator 208. Compressor 212 compresses primary refrigerant discharged by compressor 210. Cooling system 200 may include any number of compressors 210 and/or 212. Both compressors 210 and 212 compress refrigerant to increase the pressure of the refrigerant. As a result, the heat in the refrigerant may become concentrated and the refrigerant may become a high-pressure gas. Compressor 210 compresses refrigerant from accumulator 208 and sends the compressed refrigerant to compressor 212. Compressor 112 compresses the refrigerant from compressor 210. When compressors 210 and 212 compress refrigerant, oil that coats certain components of compressors 210 and 212 may mix with and be discharged with the refrigerant.

Oil separator 214 separates an oil from the primary refrigerant discharged by compressor 212. The oil may be introduced by certain components of system 200, such as compressors 210 and/or 212. By separating out the oil from the refrigerant, the efficiency of other components (e.g., high side heat exchanger 202 and low side heat exchangers 206A and 206B) is maintained. If oil separator 214 is not present, then the oil may clog these components, which may reduce the heat transfer efficiency of system 200. Oil separator 214 may not completely remove the oil from the refrigerant, and as a result, some oil may still flow into other components of system 200 (e.g., low side heat exchangers 206A and 206B).

Valves 216A and 216B control a flow of primary refrigerant from flash tank 204 to low side heat exchangers 206A and 206B. System 200 may include any suitable number of valves 216 based on the number of low side heat exchangers 206 in system 200. Valve 216A and 216B may be thermal expansion valves that cool refrigerant flowing through valves 216A and 216B. For example, valves 216A and 216B may reduce the pressure and therefore the temperature of the refrigerant flowing through valves 216A and 216B. Valves 216A and 216B reduce pressure of the refrigerant flowing into valves 216A and 216B. The temperature of the refrigerant may then drop as pressure is reduced. As a result, refrigerant entering valves 216A and 216B may be cooler when leaving valves 216A and 216B. When valve 216A is open, primary refrigerant flows from flash tank 204 to low side heat exchanger 206A. When valve 216A is closed, primary refrigerant does not flow from flash tank 204 to low side heat exchanger 206A. When valve 216B is open, primary refrigerant flows from flash tank 204 to low side heat exchanger 206B. When valve 216B is closed, primary refrigerant does not flow from flash tank 204 to low side heat exchanger 206B.

Valves 218A and 218B control a flow of refrigerant and/or oil from low side heat exchangers 206A and 206B to vessels 222A and 222B. System 200 may include any suitable number of valves 218 based on the number of low side heat exchangers 206 in system 200. During the oil drain mode of operation, valves 218A and 218B may be open to allow refrigerant and/or oil to flow from low side heat exchanger 206A and 206B to vessels 222A and 222B. During the normal mode of operation and the oil return mode of operation, valves 218A and 218B may be closed. In certain embodiments, valve 218A and 218B may be solenoid valves.

Valves 220A and 220B control a flow of refrigerant from compressor 210 to vessels 222A and 222B. System 200 may include any suitable number of valves 220 based on the number of low side heat exchangers 206 in system 200. In certain embodiments, valves 220A and 220B may be solenoid valves. During the oil return mode of operation, valves 220A and 220B may be open to allow refrigerant from compressor 210 to flow to vessels 222A and 222B. That refrigerant pushes oil and/or refrigerant that has collected in vessels 222A and 222B towards accumulator 208 and/or compressors 210 and 212. During the normal mode of operation and the oil drain mode of operation, valves 220A and 220B are closed.

Vessels 222A and 222B collect oil and/or refrigerant for low side heat exchangers 206A and 206B. System 200 may include any suitable number of vessels 222 based on the number of low side heat exchangers 206 in system 200. By collecting oil in vessels 222A and 222B, that oil is allowed to drain from low side heat exchangers 206A and 206B, thereby improving the efficiency of low side heat exchangers 206A and 206B. During the oil drain mode of operation, oil drains from low side heat exchangers 206A and 206B into vessels 222A and 222B. During the oil return mode of operation, refrigerant from compressor 210 pushes oil that has collected in vessels 222A and 222B towards accumulator 208 and/or compressors 210 and 212. During the normal mode of operation, valves 218A, 218B, 220A, and 220B are closed to prevent refrigerant and oil from flowing into vessels 222A and 222B. Vessels 222A and 222B may include any suitable components for holding and/or storing refrigerant and/or oil. For example, vessels 222A and 222B may include one or more of a container/tank and a coil (e.g., a container/tank only, a coil only, a container/tank and a coil arranged in series with one another, a coil disposed within a container/tank, etc.). The container/tank and/or coil may be of any suitable shape and size.

Valves 224A and 224B control a flow of refrigerant from low side heat exchangers 206A and 206B to accumulator 208. System 200 may include any suitable number of valves 224 based on the number of low side heat exchangers 206 in system 200. In certain embodiments, valves 224A and 224B are check valves that allow refrigerant to flow when a pressure of that refrigerant exceeds a threshold. In this manner, valves 224A and 224B direct a flow of refrigerant from low side heat exchangers 206A and 206B to accumulator 208 and control a pressure of the refrigerant flowing to accumulator 208.

Valve 226 controls a flow of refrigerant from flash tank 204 to compressor 212. Valve 226 may be referred to as a flash gas bypass valve because the refrigerant flowing through valve 226 may take the form of a flash gas from flash tank 204. If the pressure of the refrigerant in flash tank 204 is too high, valve 226 may open to direct flash gas from flash tank 204 to compressor 212. As a result, the pressure of flash tank 204 may be reduced.

Controller 228 controls the operation of cooling system 200. For example, controller 228 may cause certain valves to open and/or close to transition cooling system 200 from one mode of operation to another. Controller 228 includes a processor 230 and a memory 232. This disclosure contemplates processor 230 and memory 232 being configured to perform any of the operations of controller 228 described herein.

Processor 230 is any electronic circuitry, including, but not limited to microprocessors, application specific integrated circuits (ASIC), application specific instruction set processor (ASIP), and/or state machines, that communicatively couples to memory 232 and controls the operation of controller 228. Processor 230 may be 8-bit, 16-bit, 32-bit, 64-bit or of any other suitable architecture. Processor 230 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 230 may include other hardware that operates software to control and process information. Processor 230 executes software stored on memory to perform any of the functions described herein. Processor 230 controls the operation and administration of controller 228 by processing information received from sensors 234 and memory 232. Processor 230 may be a programmable logic device, a microcontroller, a microprocessor, any suitable processing device, or any suitable combination of the preceding. Processor 230 is not limited to a single processing device and may encompass multiple processing devices.

Memory 232 may store, either permanently or temporarily, data, operational software, or other information for processor 230. Memory 232 may include any one or a combination of volatile or non-volatile local or remote devices suitable for storing information. For example, memory 232 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 232, a disk, a CD, or a flash drive. In particular embodiments, the software may include an application executable by processor 230 to perform one or more of the functions described herein.

Sensors 234 may include one or more sensors 234 that detect characteristics of cooling system 200. For example, sensors 234 may include one or more temperature sensors that detect the temperature of refrigerant in cooling system 200. In certain embodiments, these temperature sensors may detect the temperature of a primary refrigerant in low side heat exchangers 206A and/or 206B and a temperature of secondary refrigerant in low side heat exchangers 206A and 206B. In some embodiments, sensors 234 include one or more level sensors that detect a level of oil in cooling system 200.

Controller 228 may transition system 200 from one mode of operation to another based on the detections made by one or more sensors 234. For example, controller 228 may transition cooling system 200 from the normal mode of operation to the oil drain mode of operations when the difference between the detected temperatures of the primary refrigerant and a secondary refrigerant increases above a threshold. As another example, controller 228 may transition cooling system 200 from the normal mode of operation to the oil drain mode of operation when a detected level of oil in cooling system 200 falls below or exceeds a threshold. Controller 228 may transition system 200 between different modes of operation by controlling various components of system (e.g., by opening and/or closing valves).

The different modes of operation of cooling system 200 will now be described using FIGS. 2A-2C. FIG. 2A illustrates cooling system 200 operating in a normal mode of operation. During the normal mode of operation, valves 216A and 216B are open to allow primary refrigerant from flash tank 204 to flow to low side heat exchangers 206A and 206B. Low side heat exchangers 206A and 206B transfer heat from secondary refrigerants to the primary refrigerant. The cooled secondary refrigerant is then cycled to cooling systems 106A and 106B. The heated primary refrigerant is directed through valves 224A and 224B to accumulator 208. Accumulator 208 separates gaseous and liquid portions of the received refrigerant. Compressor 210 compresses the gaseous refrigerant from accumulator 208. Compressor 212 compresses the refrigerant from compressor 210. Valves 218A, 218B, 220A, and 220B are closed.

As cooling system 200 operates in the normal mode of operation, oil from compressors 210 and/or 212 may begin to build in low side heat exchangers 206A and/or 206B. As this oil builds, the efficiency of low side heat exchangers 206A and/or 206B may decrease. In certain embodiments, the drop in efficiency in low side heat exchangers 206A and/or 206B may cause less heat transfer to occur within low side heat exchangers 206A and/or 206B. As a result, the temperature differential between the primary refrigerant and the secondary refrigerant in low side heat exchangers 206A and/or 206B may increase. One or more sensors 234 may detect a temperature of the primary refrigerant and a temperature of the secondary refrigerant in low side heat exchangers 206A and/or 206B. When controller 228 determines that this temperature differential increases above a threshold, controller 228 may determine that the oil building up in low side heat exchangers 206A and/or 206B should be drained and returned to compressors 210 and/or 212. As a result, controller 228 may transition cooling system 200 from the normal mode of operation to the oil drain mode of operation.

In certain embodiments, one or more sensors 234 may detect a level of oil in cooling system 200. For example, one or more sensors 234 may detect a level of oil in low side heat exchangers 206A and/or 206B or a level of oil in a reservoir of oil separator 214. Based on the detected levels of oil, controller 228 may transition cooling system 200 from the normal mode of operation to the oil drain mode of operation. For example, if one or more sensors 234 detect that a level of oil in low side heat exchanger 206A or 206B exceeds a threshold, controller 228 may determine that the oil in low side heat exchanger 206A or 206B should be drained and transition cooling system 200 from the normal mode of operation to the oil drain mode of operation. As another example, if one or more sensors 234 detect that a level of oil in a reservoir of oil separator 214 falls below a threshold, controller 228 may determine that low side heat exchanger 206A or 206B should be drained and transition cooling system 200 from the normal mode of operation to the oil drain mode of operation.

FIG. 2B illustrates cooling system 200 operating in the oil drain mode of operation. To transition cooling system 200 from the normal mode of operation to the oil drain mode of operation, controller 228 closes one of valves 216A and 216B. In this manner, primary refrigerant stops flowing from flash tank 204 to one of low side heat exchangers 206A and 206B. In the example of FIG. 2B, valve 216A is closed and valve 216B is open. In this manner, primary refrigerant continues to flow to low side heat exchanger 206B and oil in low side heat exchanger 206A is allowed to drain. This disclosure contemplates that valve 216B may instead be closed and valve 216A remains open during the oil drain mode. Generally, cooling system 200 may drain oil from any suitable number of low side heat exchangers 206 while allowing other low side heat exchangers 206 to operate in a normal mode of operation.

During the oil drain mode of operation, controller 228 also opens one of valves 218A and 218B. In the example of FIG. 2B, valve 218A is open to allow refrigerant and/or oil to drain from low side heat exchanger 206A through valve 218A to vessel 222A. Valve 218B remains closed. In this manner, oil that has collected in low side heat exchanger 206A is directed to vessel 222A by valve 218A. This disclosure contemplates controller 228 opening any suitable number of valves 218 during the oil drain mode while keeping other valves 218 closed so that their corresponding low side heat exchangers 206 may operate in the normal mode of operation. Controller 228 keeps valves 220A and 220B closed during the oil drain mode of operation.

Controller 228 may transition cooling system 200 from the oil drain mode of operation to the oil return mode of operation after cooling system 200 has been in the oil drain mode of operation for a particular period of time (e.g., one to two minutes). After that period of time, cooling system 200 transitions from the oil drain mode of operation to the oil return mode of operation.

FIG. 2C illustrates cooling system 200 in the oil return mode of operation. In the example of FIG. 2C, controller 228 transitions low side heat exchanger 206A to the oil return mode of operation.

During the oil return mode of operation, valve 216A remains closed so that low side heat exchanger 206A does not receive primary refrigerant from flash tank 204. Valve 218A is closed so that oil and refrigerant from low side heat exchanger 206A does not continue draining to vessel 222A. Controller 228 opens valve 220A, so that valve 220A directs refrigerant from compressor 210 into vessel 222A. This refrigerant pushes the oil in vessel 222A to accumulator 208. The oil then collects in accumulator 208. In certain embodiments, accumulator 208 includes a hole 236 in the U-shaped pipe through which oil that is collecting at the bottom of accumulator 208 may be sucked into the U-shaped pipe and be directed to compressor 210. As a result, the oil that is collected by accumulator 208 may be returned to compressor 210. Valve 216B is open and valves 218B and 220B are closed so that low side heat exchanger 206B supplies refrigerant to compressor 210 that can be directed through valve 220A.

In particular embodiments, controller 228 transitions cooling system 200 from the oil return mode of operation back to the normal mode of operation after cooling system 200 has been in the oil return mode of operation for a particular period of time (e.g., ten to twenty seconds). To transition the example of FIG. 2C back to the normal mode of operation, controller 228 closes valve 220A and opens valve 216A.

Although FIGS. 2A-2C show cooling system 200 transitioning through the normal mode of operation, the oil drain mode of operation, and the oil return mode of operation to drain and return oil collected in low side heat exchanger 206A, this disclosure contemplates cooling system 200 transitioning through these three modes of operation for any low side heat exchanger 206 in system 200. By transitioning through these three modes, oil that is collected in low side heat exchanger 206 may be returned to compressor 210 and/or compressor 212 in particular embodiments.

FIG. 3 is a flowchart illustrating a method 300 of operating an example cooling system 200. In particular embodiments, various components of cooling system 200 perform the steps of method 300. By performing method 300, an oil that has collected in a low side heat exchanger 206 may be returned to a compressor 210 or 212.

A high side heat exchanger 202 removes heat from a primary refrigerant (e.g., carbon dioxide) in step 302. In step 304, a flash tank 204 stores the primary refrigerant. In step 306, controller 228 determines whether cooling system 200 should be in a first mode of operation (e.g., a normal mode of operation). For example, controller 228 may determine a difference in the temperature between a primary refrigerant and a secondary refrigerant in low side heat exchanger 206 to determine whether cooling system 200 should be in the first mode of operation. As another example, controller 228 may determine a level of oil in the cooling system 200 to determine whether the cooling system 200 should be in the first mode of operation.

If the system should be in the first mode of operation, controller 228 closes valves 218A and/or 220A (if they are not already closed) in step 308. In step 310, low side heat exchanger 206A uses the primary refrigerant to cool a secondary refrigerant. Accumulator 208 receives the primary refrigerant from low side heat exchanger 206A in step 312. Compressor 210 compresses the primary refrigerant from accumulator 208 in step 314. In step 316, compressor 212 compresses the primary refrigerant from compressor 210.

If controller 228 determines that cooling system 200 should not be in the first mode of operation, controller 228 determines whether cooling system 200 should be in the second mode of operation (e.g., an oil drain mode of operation) in step 318. As discussed previously, controller 228 may determine whether cooling system 200 should be in the second mode of operation based on a detected temperature differential and/or oil level. If controller 228 determines that cooling system 200 should be in the second mode of operation, controller 228 opens valve 218A (if valve 218A is not already open) in step 320. In step 322, controller 228 closes valve 220A (if valve 220A is not already closed). As a result, oil from low side heat exchanger 206A is allowed to drain through valve 218A to vessel 222A.

If controller 228 determines that cooling system 200 should not be in the first mode or second mode of operation, controller 228 may determine that cooling system 200 should be in a third mode of operation (e.g., an oil return mode of operation). In response, controller 228 closes valve 218A (if valve 218A is not already closed) in step 324. Controller 228 then opens valve 220A (if valve 220A is not already opened) in step 326. As a result, refrigerant from compressor 210 flows to vessel 222A through valve 220A to push oil that is collected in vessel 222A to accumulator 208. The oil collected in accumulator 208 may then be sucked back to compressor 210 and/or compressor 212.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the compressor, the refrigerant from the flash tank, etc.). When such terminology is used, this disclosure is not limiting the described refrigerant to being directly from the particular component. This disclosure contemplates refrigerant being from a particular component (e.g., the low side heat exchanger) even though there may be other intervening components between the particular component and the destination of the refrigerant. For example, the compressor receives a refrigerant from the low side heat exchanger even though there may be valves, vessels, and/or an accumulator between the low side heat exchanger and the compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a flash tank configured to store a primary refrigerant;

a first low side heat exchanger;

an accumulator that comprises a U-shaped pipe having an end configured to receive the primary refrigerant, and wherein the U-shaped pipe comprises a hole located towards a bottom of the accumulator;

a first compressor;

a second compressor;

a first valve;

a first cooling system fluidly coupled to the first low side heat exchanger; and a second valve associated with the first low side heat exchanger;

wherein during a first mode of operation:

the first and second valves are closed;

the first low side heat exchanger is configured to use the primary refrigerant from the flash tank to cool a secondary refrigerant;

the accumulator is configured to receive the primary refrigerant from the first low side heat exchanger;

the first cooling system is configured to receive the cooled secondary refrigerant;

the first compressor is configured to compress the primary refrigerant from the accumulator; and the second compressor is configured to compress the primary refrigerant from the first compressor, wherein during a second mode of operation:

the first valve is open and configured to direct the primary refrigerant from the first low side heat exchanger and an oil from the first low side heat exchanger to a first vessel; and the second valve is closed, wherein during a third mode of operation:

the first valve is closed; and the second valve is open and directs the primary refrigerant from the first compressor to the first vessel, wherein the primary refrigerant from the first compressor pushes the oil in the first vessel to the accumulator, and wherein the oil collected at the bottom of the accumulator is sucked through the hole in the U-shaped pipe and directed to the first compressor.

2. The system of claim 1, further comprising:

a first sensor configured to detect a temperature of the primary refrigerant in the first low side heat exchanger; and a second sensor configured to detect a temperature of the secondary refrigerant, the system transitions from the first mode of operation to the second mode of operation when a difference between the temperature detected by the first sensor and the temperature detected by the second sensor exceeds a threshold.

3. The system of claim 1, further comprising a check valve that directs primary refrigerant from the first low side heat exchanger to the accumulator when a pressure of the primary refrigerant exceeds a threshold.

4. The system of claim 1, further comprising:

a second low side heat exchanger;

a third valve; and a fourth valve, during the first, second, and third modes of operation:

the third and fourth valves are closed;

the second low side heat exchanger uses primary refrigerant from the flash tank to cool a tertiary refrigerant; and the accumulator receives primary refrigerant from the second low side heat exchanger.

5. The system of claim 1, wherein during the third mode of operation, the second valve receives primary refrigerant directly from the first compressor.

6. The system of claim 1, further comprising a sensor configured to detect a level of the oil, the system transitions from the first mode of operation to the second mode of operation when the detected level falls below a threshold.

7. The system of claim 4, further comprising a second vessel disposed between the third valve and the accumulator.

8. A method comprising:

storing, by a flash tank, a primary refrigerant;

during a first mode of operation:

closing a first valve and a second valve;

using, by a first low side heat exchanger, primary refrigerant from the flash tank to cool a secondary refrigerant, wherein both the first valve and the second valve are each associated with the first low side heat exchanger;

receiving, by an accumulator, primary refrigerant from the first low side heat exchanger, wherein the accumulator comprises a U-shaped pipe having an end configured to receive the primary refrigerant, and wherein the U-shaped pipe comprises a hole located towards a bottom of the accumulator;

receiving, by a first cooling system fluidly coupled to the first low side heat exchanger, the cooled secondary refrigerant;

compressing, by a first compressor, primary refrigerant from the accumulator; and compressing, by a second compressor disposed downstream of the first compressor, primary refrigerant from the first compressor, during a second mode of operation:

opening the first valve;

closing the second valve; and directing, by the first valve, primary refrigerant from the first low side heat exchanger and an oil from the first low side heat exchanger to a first vessel; and during a third mode of operation:

closing the first valve;

opening the second valve;

directing, by the second valve, primary refrigerant from the first compressor to the first vessel; and pushing, by the primary refrigerant from the first compressor, the oil in the first vessel to the accumulator and wherein the oil collected at the bottom of the accumulator is sucked through the hole in the U-shaped pipe and directed to the first compressor.

9. The method of claim 8, further comprising:

detecting, by a first sensor, a temperature of the primary refrigerant in the first low side heat exchanger;

detecting, by a second sensor, a temperature of the secondary refrigerant; and transitioning from the first mode of operation to the second mode of operation when a difference between the temperature detected by the first sensor and the temperature detected by the second sensor exceeds a threshold.

10. The method of claim 8, further comprising directing, by a check valve, primary refrigerant from the first low side heat exchanger to the accumulator when a pressure of the primary refrigerant exceeds a threshold.

11. The method of claim 8, further comprising, during the first, second, and third modes of operation:

closing a third valve and a fourth valve;

using, by a second low side heat exchanger, primary refrigerant from the flash tank to cool a tertiary refrigerant; and receiving, by the accumulator, primary refrigerant from the second low side heat exchanger.

12. The method of claim 8, further comprising, during the third mode of operation, the second valve receives primary refrigerant directly from the first compressor.

13. The method of claim 8, further comprising:

detecting, by a sensor, a level of the oil; and transitioning from the first mode of operation to the second mode of operation when the detected level falls below a threshold.

14. The method of claim 11, wherein a second vessel is disposed between the third valve and the accumulator.

15. A system comprising:

a high side heat exchanger configured to remove heat from a primary refrigerant;

a flash tank configured to store the primary refrigerant;

a first low side heat exchanger;

an accumulator that comprises a U-shaped pipe having an end configured to receive the primary refrigerant, and wherein the U-shaped pipe comprises a hole located towards a bottom of the accumulator;

a first compressor;

a second compressor;

a first valve;

a first cooling system fluidly coupled to the first low side heat exchanger; and a second valve associated with the first low side heat exchanger;

wherein during a first mode of operation:

the first and second valves are closed;

the first low side heat exchanger is configured to use primary refrigerant from the flash tank to cool a secondary refrigerant;

the accumulator is configured to receive the primary refrigerant from the first low side heat exchanger;

the first cooling system is configured to receive the cooled secondary refrigerant;

the first compressor is configured to compress the primary refrigerant from the accumulator; and the second compressor is configured to compress the primary refrigerant from the first compressor, wherein during a second mode of operation:

the first valve is open and configured to direct the primary refrigerant from the first low side heat exchanger and an oil from the first low side heat exchanger to the vessel; and the second valve is closed, wherein during a third mode of operation:

the first valve is closed; and the second valve is open and directs the primary refrigerant from the first compressor to the vessel, wherein the primary refrigerant from the first compressor pushes the oil in the vessel to the accumulator, and wherein the oil collected at the bottom of the accumulator is sucked through the hole in the U-shaped pipe and directed to the first compressor.

16. The system of claim 15, further comprising:

a first sensor configured to detect a temperature of the primary refrigerant in the first low side heat exchanger; and a second sensor configured to detect a temperature of the secondary refrigerant, the system transitions from the first mode of operation to the second mode of operation when a difference between the temperature detected by the first sensor and the temperature detected by the second sensor exceeds a threshold.

17. The system of claim 15, further comprising a check valve that directs primary refrigerant from the first low side heat exchanger to the accumulator when a pressure of the primary refrigerant exceeds a threshold.

18. The system of claim 15, further comprising:

a second low side heat exchanger;

a third valve; and a fourth valve, during the first, second, and third modes of operation:

the third and fourth valves are closed;

the second low side heat exchanger uses primary refrigerant from the flash tank to cool a tertiary refrigerant; and the accumulator receives primary refrigerant from the second low side heat exchanger.

19. The system of claim 15, wherein during the third mode of operation, the second valve receives primary refrigerant directly from the first compressor.

20. The system of claim 15, further comprising a sensor configured to detect a level of the oil, the system transitions from the first mode of operation to the second mode of operation when the detected level falls below a threshold.

* * * * *